United States Patent [19]

Frisoli

[11] Patent Number: 4,697,366

[45] Date of Patent: Oct. 6, 1987

[54] CHAMBER INDICATOR FOR A REVOLVER OR A HAND-HELD GUN

[76] Inventor: David M. Frisoli, 2 Homestead Dr., Edison, N.J. 08817

[21] Appl. No.: 747,970

[22] Filed: Jun. 24, 1985

[51] Int. Cl.[4] ..... F41C 27/14

[52] U.S. Cl. ..... 42/1.05; 42/1.02; 116/307

[58] Field of Search ..... 42/1 A, 1 D, 1 E, 59, 42/66, 87, 88, 89, 1.01, 1.02, 1.05; 116/200, 307, 312, 314, 315, 294, 298, 230

[56] References Cited

U.S. PATENT DOCUMENTS

| | | | |
|---|---|---|---|
| 611,284 | 9/1888 | Savage | 42/1.02 |
| 1,867,513 | 7/1932 | Lahti | 89/33.02 |
| 1,980,844 | 10/1933 | Ball | 116/223 |
| 2,117,441 | 4/1938 | McWeeny | 116/298 |
| 3,735,099 | 5/1973 | Herr | 116/298 |
| 4,261,528 | 4/1981 | McKinney | 116/307 |
| 4,483,088 | 11/1984 | Tussing | 42/1 D |
| 4,558,626 | 12/1985 | Bartolles | 42/1 B |

*Primary Examiner*—Deborah L. Kyle
*Assistant Examiner*—Michael J. Carone
*Attorney, Agent, or Firm*—Arthur L. Plevy

[57] ABSTRACT

There is disclosed a chamber indicator apparatus for a conventional revolver. The chamber indicator apparatus employs an aperture in the recoil plate which aperture abuts against the back end of the cylinder and allows one to view a given area of the cylinder via the aperture. The viewed cylinder area has emplaced thereon indicia indicative of the chamber which is aligned with the barrel of the gun. In this manner, the user can view the indicia via the aperture and hence identify the chamber accommodating the cartridge that is to be fired. Accordingly, the user now has the knowledge of the number of shots fired as well as the chamber being used at all times during the firing of a weapon.

10 Claims, 4 Drawing Figures

CHAMBER INDICATOR FOR A REVOLVER OR A HAND-HELD GUN

BACKGROUND OF THE INVENTION

This invention relates to a revolver or hand-held weapon of the type employing a rotatable cylinder.

The revolver has been in existence for many years, and essentially most revolvers are hand-held weapons and operate on exactly the same principles. Such revolvers have a barrel, a body and a handle. The major aspect of the revolver is that the revolver has a cylinder which cylinder contains a plurality of chambers such as a six chambers. Each chamber is adapted to accommodate a bullet or cartridge.

The revolver is associated with a trigger mechanism whereby when the trigger is depressed, the cartridge in the chamber which is aligned with the firing pin is fired through the barrel and the cylinder automatically turns or rotates to the next chamber. As can be ascertained, most users of such weapons do not normally keep track of how many shots are fired. After hearing a series of clicks, when the gun is emptied, they are informed that the revolver has fired all shots and must be reloaded. The only way of keeping track of the number of shots fired is to actually count the shots, and after, for example, six shots have been fired then the user would know that the revolver would have to be loaded.

This, of course, places an additional burden upon a user in that the number of shots fired have to be counted or otherwise indicated to the user. This aspect is particularly important as such revolvers are employed in law enforcement whereby an officer or other official might be utilizing a revolver during a chase or in another stressful situation. In such situations, it would be extremely difficult to keep count of the shots fired.

Based on such circumstances, it is an object of this invention to provide a safety device which essentially constitutes a chamber indicator whereby a user of a revolver or similar firearm can immediately note the chamber that is being employed, and hence by viewing the chamber number or indicia indicative of the chamber, the user can now tell whether or not all the cartridges have been spent as well as which chamber is actually being employed during the firing of the gun.

BRIEF DESCRIPTION OF THE PREFERRED EMBODIMENT

In a revolver having a rotatable cylinder, said cylinder having a plurality of chambers each for accommodating a separate cartridge, said cylinder rotatably mounted on the revolver body and having a back end which faces a user when firing the revolver, with said end abutting against a recoil plate, which plate is rigidly secured to said body, said cylinder operative to rotate each time the revolver is fired to position a new chamber and hence an accommodated cartridge in alignment with the firing pin and barrel of said revolver, the combination therewith of apparatus for informing the user of which one of the plurality of chambers is an alignment with said barrel and firing pin, comprising indicia means located on said back end of said cylinder and capable of identifying one chamber from another chamber, and viewing means associated with said recoil plate to enable said user to view said indicia whereby said user can identify any of said plurality of chambers via said viewing means.

DETAILED DESCRIPTION OF THE FIGURES

Figure 1:
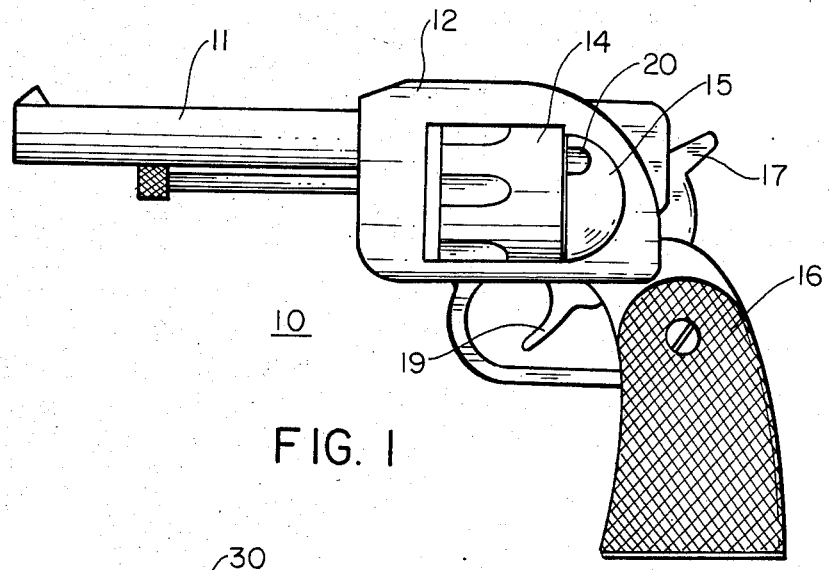
FIG. 1 is a side elevational view of a revolver employing a chamber indicator according to this invention.

Referring to FIG. 1, there is shown a side elevational view of a typical revolver 10.

At the onset, it is indicated that such revolvers come in various sizes, shapes and forms, but all function in a similar manner. Hence the revolver 10 is merely indicative of the class of fire arms which employ a rotating cylinder having chambers for accommodating cartridges or bullets.

The revolver 10 has a barrel section 11 through which the bullet is fired. The body 12 of the revolver is located as shown behind the barrel and contains a cylinder 14. The cylinder 14 contains a plurality of chambers into which cartridges or loaded bullets are inserted. As is well known, most revolvers have six chambers to allow one to fire six shots. The cylinder 14, as its name implies, is a cylindrical member having a back surface which abuts against a recoil plate 15. The recoil plate 15 is rigidly secured to the body 12 of the revolver and has the back surface of the cylinder abutting against the same.

Essentially, the recoil plate covers the entire back of the cylinder and functions to keep the cartridge in place during operation of the fire arm as well as to absorb recoil forces which are generated during the firing of the weapon. The revolver has a handle portion 16 and has a hammer 17 which is associated with a firing pin (not shown). Located on the underside of the body of the gun is the trigger mechanism 19. In operation, when the trigger is depressed, the hammer moves towards the cylinder where the firing pin strikes the cartridge and disperses the bullet.

Each time the trigger is depressed or the gun is fired, the cylinder rotates to align the next chamber, and therefore the next cartridge with the firing pin and the barrel. This is an automatic action and is an inherent part of the operation of every revolver.

Shown in FIG. 1 is an aperture 20. The aperture 20 is formed in the recoil plate 15 and coacts with the back end or back face of the cylinder. The aperture 20 is formed in the recoil plate by a typical machining operation and, as will be explained, allows the user of the gun to view indicia which indicates to the user the chamber that is being employed.

Figure 2:
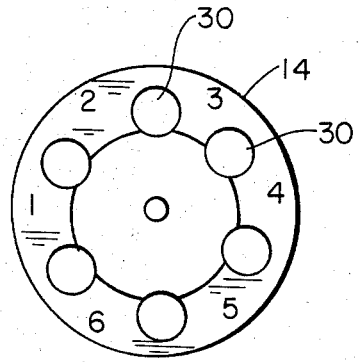
FIG. 2 is a rear view of a cylinder utilized in the revolver of FIG. 1.

Referring to FIG. 2, there is shown a rear view of a typical cylinder 14. As indicated, the cylinder 14 contains a plurality of chambers 30, each of which is adapted to accommodate a cartridge or a bullet. The loading of the cylinder is well known as the cylinder pivots out of the body of the gun during loading and is inserted back into place after cartridges have been placed in the chambers 30.

As shown in FIG. 2, the spaces between the chambers 30 are labeled as for example 1 to 6. The positions of the numerals are such that as the weapon is fired and the cylinder is rotated, a new chamber is aligned with the barrel of the gun, and the associated numeral is viewed through the aperture 20 in the recoil plate. This is shown in detail in FIG. 3.

Figure 3:
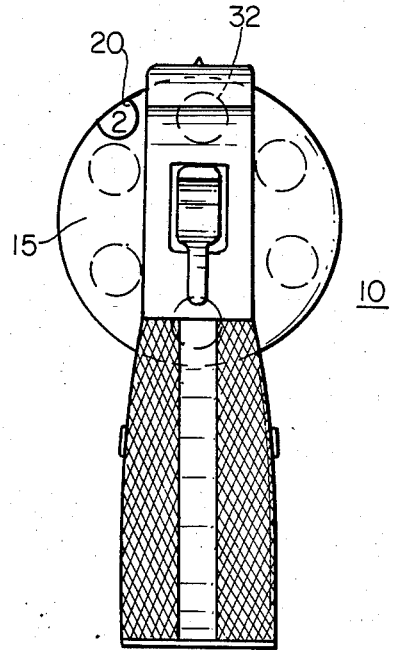
FIG. 3 is a rear view of the revolver as viewed by a user in a firing position.

In FIG. 3, the aperture 20 in the recoil plate 15 allows one to see the numeral 2 indicating that chamber 32 associated with numeral 2 is the chamber which is aligned with the firing pin and the barrel. In this manner, the user, when loading a gun, can rotate the cylinder to chamber 1, and after firing each shot, a new number will appear as viewed via the aperture 20 to indicate to the user the identification of the next cartridge to be fired of the associated chamber.

Hence when all bullets are discharged or when the last chamber is accommodated, the user will see the numeral 6 through the aperture 20 in the recoil plate 15. FIG. 3 also shows the revolver 10 as perceived by a user in a normal firing position. The user cannot avoid seeing the numeral 2 when the gun is being fired due to the fact that he is aiming the gun and can easily see the chamber indicia that he is concerned with during the firing of the gun. It is, of course, understood that the numerals such as those shown in FIG. 2 can be engraved, stamped or otherwise imprinted on the cylinder at the appropriate locations by many conventional techniques.

It is also understood that in lieu of numbers, one can employ letters, color coding or any other indicia to indicate the chamber being employed. Thus one may utilize colored areas and for example designate the last chamber by the color red or some other predominent color to inform the user that all cartridges have been spent.

Figure 4:
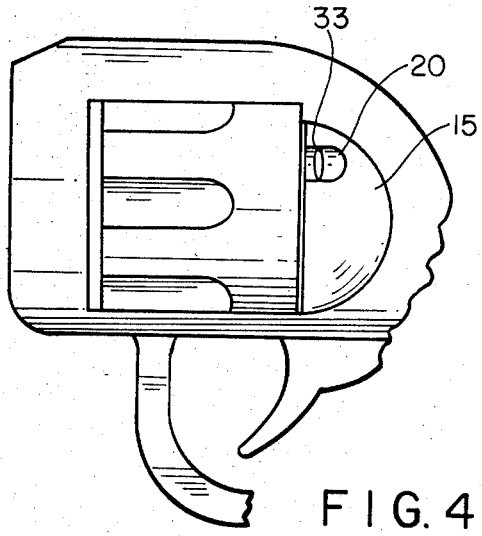
FIG. 4 is a partial view depicting a further embodiment according to this invention.

Referring to FIG. 4, there is shown a partial view depicting the aperture 20 in the recoil plate 15.

The aperture 20 in FIG. 4 contains a lens 33. The lens 33 is a magnifying lens such as the type associated with many wristwatches to view the date and so on. Essentially, it may be a piece of plastic which is secured within the aperture 20 by means of a suitable glue, epoxy or other bonding agent. The function of the lens is, of course, to enable the viewer to more clearly visualize the indicia impressed or positioned on the cylinder.

It is noted that the implementation of the above concept is extremely simple in that one need not change the structure or configuration of the revolver in any manner. The addition of the identifying material on the cylinder as one can ascertain is very simple to implement. Thus the aperture 20 which is formed in a recoil plate is also extremely simple to implement in that a conventional machining operation can be employed. As one can see, the use of this concept can be made on all existing revolvers.

The removal of the material to form the aperture 20 does not in any manner affect the operation of the weapon. While the specification discloses a partial aperture 20, it is, of course, understood that a hole could be drilled through the recoil plate to enable visualization. One could employ illuminating means as an LED device which is battery operated to further enhance the visualization of the chamber identification means.

However, the above structure is preferred in that it requires very little time to implement and provides a positive identification of the chamber employed in a simple and efficient manner. As indicated above, it is understood that many different revolvers or hand-held weapons exist and that this invention is pertinent to those which contain a rotatable cylinder abutting against a recoil plate whereby the back end of the cylinder has impressed thereon indicia indicative of the chamber being employed with the recoil plate containing the viewing means to enable a user to always be able to identify the chamber when the weapon is being fired.

I claim:

1. In a revolver having a rotatable cylinder, said cylinder having a plurality of chambers each for accommodating a separate cartridge, said cylinder rotatably mounted on the revolver body and having a back end which faces a user when firing the revolver, with said end abutting against a recoil plate, which plate is rigidly secured to said body, said cylinder operative to rotate each time the revolver is fired to position a new chamber and hence an accommodated cartridge in alignment with the firing pin and barrel of said revolver, the combination therewith of apparatus for informing the user of which one of the plurality of chambers is in alignment with said barrel and firing pin, comprising:

indicia means located on said back end of said cylinder and capable of identifying one chamber from another chamber, and viewing means associated with said recoil plate to enable said user to view said indicia, said indicia means being positioned on said back end of said cylinder in such manner that an indicia means for a particular chamber is in registration with said viewing means and viewable therefrom when said particular chamber, associated therewith, is disposed in alignment with said firing pin and barrel of said revolver whereby said user can identify any of said plurality of chambers via said viewing means during the firing of said revolver.

2. The combination according to claim 1, wherein said indicia means as located on the back end of said cylinder are positioned between said chambers.

3. The combination according to claim 1, wherein said indicia are a series of numerals each separate one capable of identifying a separate chamber.

4. The combination according to claim 1, wherein said indicia are a series of colors each separate one capable of identifying a separate chamber.

5. The combination according to claim 1, wherein said viewing means associated with said recoil plate constitutes an aperture in said recoil plate which aperture communicates with a given area of said back end of said cylinder to enable a user to view said indicia via said aperture when said revolver is held in a firing position.

6. The combination according to claim 5, further including a lens assembly located in said aperture and operative to effectively magnify said indicia as viewed.

7. A method of providing a user of a revolver with a positive indication of the chamber which is aligned with the barrel of said revolver, said revolver of the type having a rotatable cylinder having a plurality of chambers each capable of accommodating a separate cartridge, said cylinder having a back end which faces a user firing said revolver, said back end abutting against a recoil plate, comprising the steps of:

placing a plurality of indicia on said back end of said cylinder with separate ones of said indicia located between separate ones of said chambers and capable of identifying one chamber from another, forming an aperture in said recoil plate and directed from the back end of said cylinder towards the revolver handle to enable a user to view said indicia via said aperture when said revolver is held in a firing position, said steps of placing and forming being performed in said manner that an indicia for a particular chamber is in registration with said aperture and viewable therethrough when said particular chamber, associated therewith, is disposed in alignment with said barrel of said revolver.

8. The method according to claim 7, wherein said indicia are a series of numbers each separate one indicative of a different chamber and imprinted on said back end of said cylinder.

9. The method according to claim 7, wherein said indicia are a series of colors each separate one indicative of one of said chambers.

10. The method according to claim 7, including the step of placing a lens in said aperture to enable said user to view said indicia at a given magnification.

* * * * *